US010714020B1

(12) United States Patent
Zhang

(10) Patent No.: US 10,714,020 B1
(45) Date of Patent: Jul. 14, 2020

(54) ORGANIC LIGHT EMITTING DIODE DISPLAY PIXEL CROSSTALK COMPENSATION

(71) Applicant: Facebook Technologies, LLC, Menlo Park, CA (US)

(72) Inventor: Rui Zhang, Redwood City, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/786,226

(22) Filed: Oct. 17, 2017

(51) Int. Cl.
*G09G 3/3283* (2016.01)

(52) U.S. Cl.
CPC ... *G09G 3/3283* (2013.01); *G09G 2320/0209* (2013.01); *G09G 2320/0626* (2013.01)

(58) Field of Classification Search
CPC ..... G09G 3/3283; G09G 2320/0209; G09G 2320/0626
See application file for complete search history.

(56) References Cited

U.S. PATENT DOCUMENTS

2002/0030647 A1* 3/2002 Hack ..... G09G 3/3233 345/82
2009/0079767 A1* 3/2009 Morita ..... G09G 3/3688 345/690
2013/0306996 A1* 11/2013 Kitazawa ..... H01L 33/0041 257/88
2014/0085345 A1* 3/2014 Ma ..... G09G 3/3614 345/690
2015/0271392 A1* 9/2015 Musgrave ..... G09G 3/3208 348/207.11
2016/0117971 A1* 4/2016 Scchetto ..... G09G 3/20 345/589
2016/0358299 A1* 12/2016 Toth ..... G06T 19/006
2017/0169758 A1* 6/2017 Park ..... G09G 3/2003
2018/0102091 A1* 4/2018 Deng ..... H01L 27/3241

* cited by examiner

*Primary Examiner* — Amit Chatly
(74) *Attorney, Agent, or Firm* — Freestone Intellectual Property Law PLLC; Aaron J. Visbeek

(57) ABSTRACT

A portion of an image frame of video content is received and a grey level total of the portion of the image frame is calculated. A grey level offset value corresponding to the grey level total is determined. The grey level offset value corresponds to a pixel portion of an Organic Light Emitting Diode (OLED) display that will display the portion of the image frame. Compensated pixel grey levels are generated by adjusting individual pixel grey levels using the grey level offset value. The compensated pixel grey levels are driven onto the pixel portion of the OLED display.

16 Claims, 6 Drawing Sheets

ORGANIC LIGHT EMITTING DIODE DISPLAY PIXEL CROSSTALK COMPENSATION

TECHNICAL FIELD

This disclosure relates generally to Organic Light Emitting Diode (OLED) displays including but not limited to reducing pixel crosstalk in OLED displays.

BACKGROUND INFORMATION

OLED displays are often used in consumer devices and typically include an array of display pixels that are arranged by rows and columns. Each display pixel may include a red, a green, and a blue sub-pixel (RGB pattern) or a red, green, green, and a blue sub-pixel (RGGB pattern) to enable rendering of color images. OLED displays may be used to render video content to viewers by illuminating the display pixels according to image frames in video images. Display pixel crosstalk is a phenomenon where particular display pixels don't display the intended intensity due to electrical characteristics (e.g. current load) of display pixels in close proximity to the particular display pixels. This display pixel crosstalk can negatively affect the fidelity of the rendered image and become noticeable to viewers of the OLED display. Therefore, reducing display pixel crosstalk in OLED displays enhances the viewing experience.

SUMMARY

Embodiments of the disclosure include a device including an organic light emitting diode (OLED) display, a computer-readable medium, a buffer memory, an aggregation engine, an offset engine, and a compensation engine. The computer-readable medium may include a look-up-table including a plurality of table grey level offset values corresponding to table grey level offset values being specifically calibrated for the plurality of pixel portions of the OLED display. The buffer memory may be configured to receive grey levels of a portion of an image frame of video content. The aggregation engine is configured to generate a grey level total of the portion of the image frame by summing the grey levels in the buffer memory. The offset engine is configured to query the look-up-table for a grey level offset value of the plurality of table grey level offset values that corresponds to the grey level total. The grey level offset value corresponds to a pixel portion of the plurality of pixel portions of the OLED display that will display the portion of the image frame. The compensation engine is configured to receive the portion of the image frame and the compensation engine is also configured to generate compensated pixel grey levels for individual pixels in the pixel portion of the OLED display based at least in part on the grey level offset value.

In one embodiment of the disclosure, a head mounted display (HMD) includes an OLED display, a graphics processing unit (GPU), a buffer memory, an aggregation engine, an offset engine, and a compensation engine. The buffer memory is configured to receive a portion of an image frame of video content from the GPU. The offset engine may be configured to generate a grey level offset value in response to receiving the grey level total. The grey level offset value may correspond to a pixel portion of the OLED display that will display the portion of the image frame. The compensation engine may be configured to receive the portion of the image frame of video content from the GPU and configured to receive the grey level offset value from the offset engine.

The compensation engine may be configured to generate compensated pixel grey levels for individual pixels in the pixel portion of the OLED display based at least in part on the grey level offset value. The compensation engine may be further configured to provide the compensated pixel grey levels to the OLED display.

In one embodiment of the disclosure, a method of reducing display pixel crosstalk includes receiving a portion of an image frame of video content. A grey level total of the portion of the image frame is calculated. A grey level offset value corresponding to the grey level total is determined. The grey level offset value may correspond to a pixel portion of an OLED display that will display the portion of the image frame. Compensated pixel grey levels are generated. Generating the compensated pixel grey levels may include adjusting the individual pixel grey levels of the portion of the image frame based at least in part on the grey level offset value. The compensated pixel grey levels are driven onto the pixel portion of the OLED display.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1:
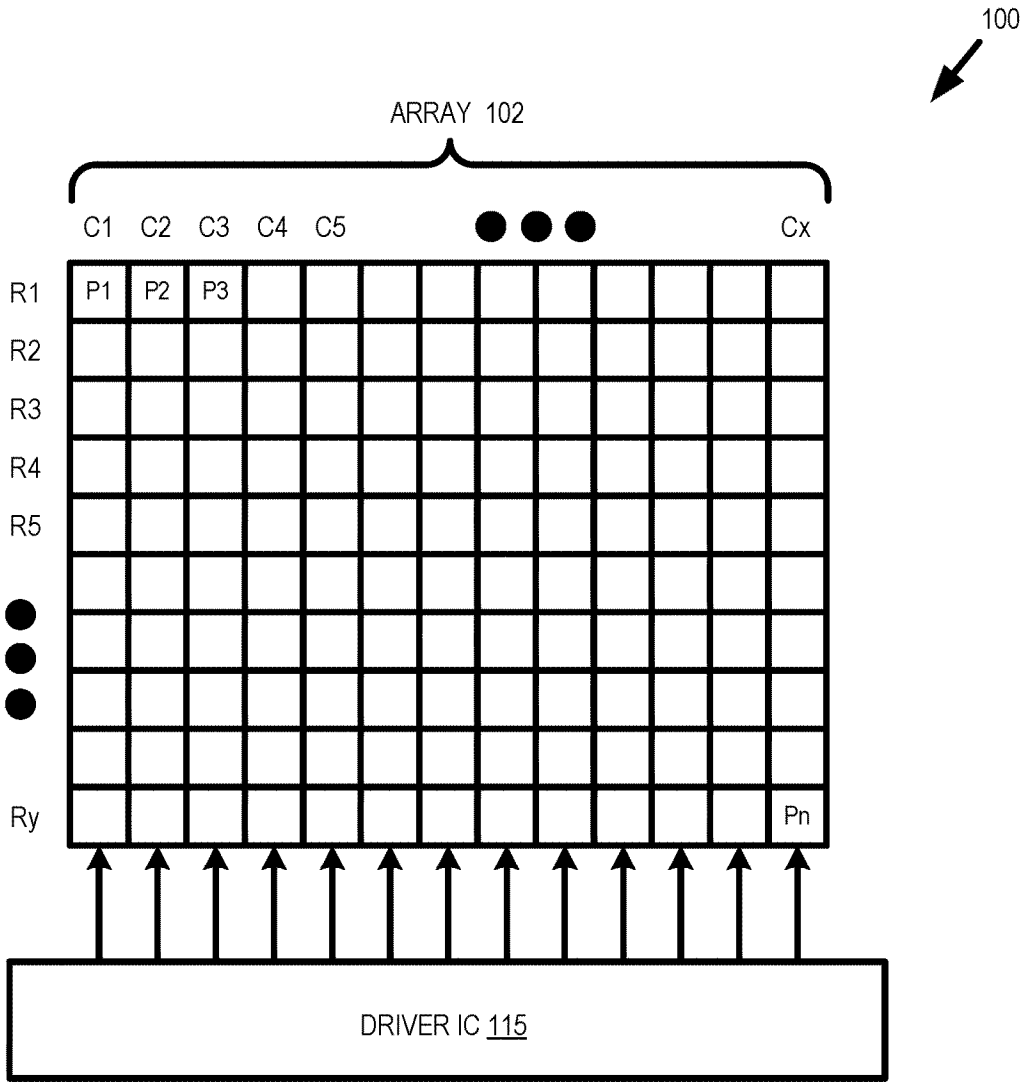
FIG. 1 illustrates an example block diagram of an OLED display including a display pixel array arranged in rows and columns and a driver integrated-circuit configured to drive the display pixels of the display pixel array, in accordance with an embodiment of the disclosure.

Embodiments of reducing pixel crosstalk in OLED displays are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Throughout this specification, several terms of art are used. These terms are to take on their ordinary meaning in the art from which they come, unless specifically defined herein or the context of their use would clearly suggest otherwise.

Systems, methods, and apparatuses described in this disclosure include adjusting grey levels of video content to reduce display pixel crosstalk in organic light emitting diode (OLED) displays. OLED displays may have OLED display pixels that are coupled to the same voltage and/or current supply and therefore the current draw of one OLED display pixel may affect the voltage and/or current available to other proximate OLED display pixels. A change in supply voltage or current therefore affects the brightness of nearby OLEDs which may manifest as undesirable artifacts in the video images that are rendered. Since the amount of electrical current a given OLED in a display pixel will sink is image dependent (brighter portions of images drawing more current than darker portions of images), video content may be analyzed to predict how bright or dark an image to be rendered is and grey levels of the portion of the image may be compensated to reduce the crosstalk between proximate display pixels.

In certain contexts, display pixel crosstalk is more pronounced. For example, high refresh rates corresponding with quicker switching of the OLEDs in the OLED display may exacerbate display pixel crosstalk. In the context of Head Mounted Displays (HMDs), "low persistence" techniques may be utilized to only illuminate OLED display pixels for a portion of a frame time allocated to an image frame. For example, if approximately 30 ms is allocated to display an image frame of video content, each OLED pixel may be illuminated for approximately 3 ms in a low persistence rolling shutter mode. A low persistence rolling shutter may mitigate certain undesirable motion effects of viewers of an HMD, yet the low persistence rolling shutter mode may increase the crosstalk between proximate display pixels. Consequently, embodiments of the disclosure may be particularly useful in low persistence rolling shutter display architectures. Embodiments of the disclosure are described in more detail below with respect to the Figures.

FIG. 1 illustrates an example block diagram of an OLED display 100 including a display pixel array 102 arranged in rows and columns and a driver integrated-circuit 115 configured to drive the display pixels P1-$P_N$ of the display pixel array 102, in accordance with an embodiment of the disclosure. Display pixel array 102 is arranged having horizontal rows R1, R2, R3, R4, R5 through $R_y$. Similarly display pixel array 102 has vertical columns C1, C2, C3, C4, C5 through $C_x$. For the purpose of this application, a "line" of display pixels may refer to a vertical column of display pixels or a horizontal row of display pixels. In one embodiment, display pixel array 102 includes 1440 horizontal rows and 1600 vertical columns. In other embodiments, display pixel array 102 may include 1920 rows and 1080 columns or 3840 rows and 2160 columns to support 1080p and 4 k images, respectively. Driver IC 115 may receive digital images including video content and facilitate driving transistors included in each display pixel of display pixel array 102 to illuminate each display pixel according to the received digital image.

Figure 2B:
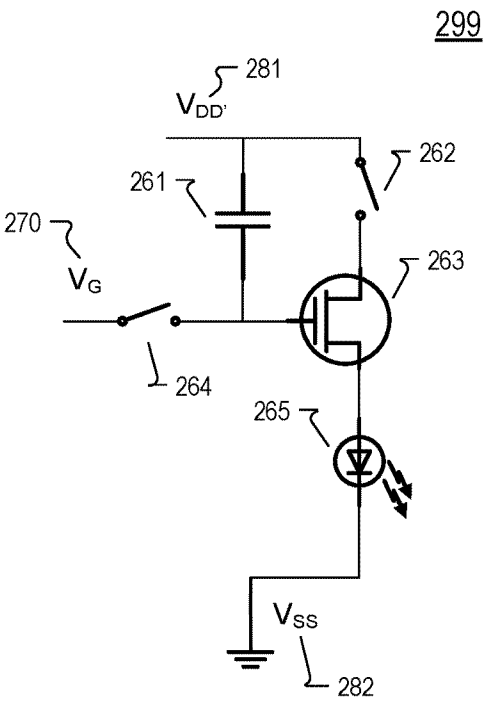
FIG. 2B illustrates an example circuit model of a display pixel including an organic light emitting diode, in accordance with an embodiment of the disclosure.
Figure 2A:
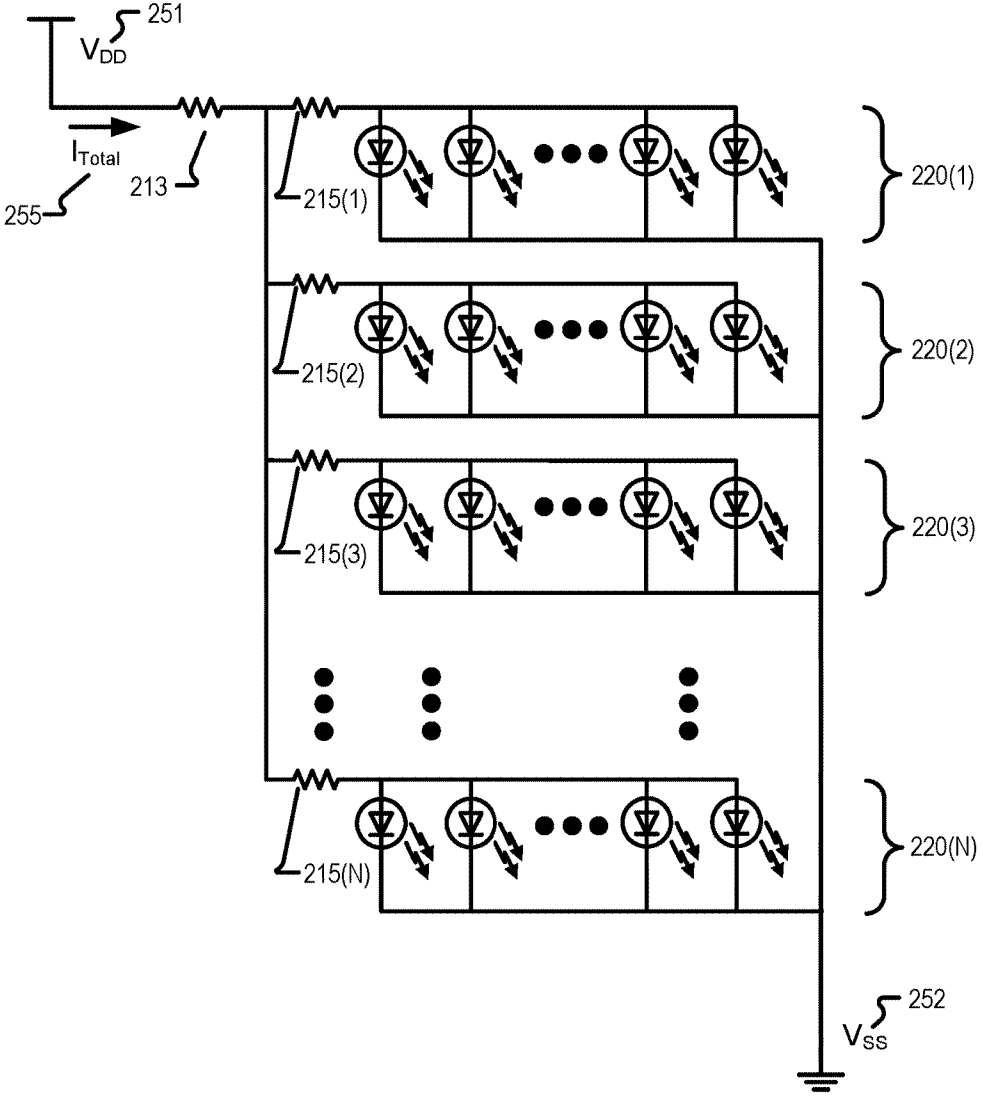
FIG. 2A illustrates organic light emitting diodes in a same line of a display pixel array being coupled to receive electrical power from a same power source, in accordance with an embodiment of the disclosure.

FIG. 2A illustrates organic light emitting diodes (OLEDs) in a same line of a display pixel array being coupled to receive electrical power from a same power source, in accordance with an embodiment of the disclosure. FIG. 2A includes lines 220(1)-220(N) of OLEDs (collectively referred to as lines 220). Each line 220 is coupled to a voltage source $V_{DD}$ 251 that supplies a total electrical current $I_{Total}$ 255 to the lines 220 of OLEDs and each line 220 is coupled to a common ground $V_{SS}$ 252. Each line 220 has a corresponding resistance value 215, in the illustrated embodiment.

FIG. 2B illustrates an example circuit model 299 of a display pixel including an organic light emitting diode 265, in accordance with an embodiment of the disclosure. In FIG. 2B, a voltage on the gate of transistor 263 controls the current provided to illuminate OLED 265. Transistor 263 is coupled between OLED 265 and voltage $V_{DD'}$ 281 which is the voltage available after $V_{DD}$ 251 is reduced by the voltage drop associated with resistance values 213 and 215. Capacitance 261 is between $V_{DD'}$ 281 and the gate of transistor 263. Switch 262 is coupled to provide $V_{DD'}$ 281 to transistor 263 and switch 264 is coupled to provide voltage $V_G$ 270 to the gate of transistor 263. Driver IC 115 may control the switching of switches 262 and 264 and also generate the voltage $V_G$ 270. Voltage $V_G$ 270 corresponds to a grey level of a digital image that is driven onto a particular display pixel. For example, if the display pixel should provide maximum brightness, an analog voltage corresponding to a maximum grey level will be driven onto the gate of transistor 263 to illuminate OLED 265 to maximum brightness while if the display pixel should provide minimum brightness, an analog voltage corresponding to a minimum grey level will be driven onto the gate of transistor 263 so that OLED 265 is not illuminated at all. Of course, analog voltages corresponding to grey levels between the maximum and minimum grey level may also be driven onto the gate of transistor 263 to illuminate OLED 265 to various brightness levels between off and maximum on.

Considering FIGS. 2A and 2B together, the current draws of proximate display pixels affect each other because of the voltage drops across resistance values 213 and 215 vary by the amount of current drawn by each OLED 265 of each display pixel. Thus, the voltage $V_{DD'}$ 281 changes based on the brightness of the image content of proximate display pixels which consequently affects the current provided to illuminate each OLED 265. This effect generates undesirable display pixel crosstalk in the rendered image that is observable by viewers of the OLED display. In one embodiment, proximate display pixels are neighboring display pixels. In one embodiment, proximate display pixels are display pixels in adjacent lines.

Figure 3A:
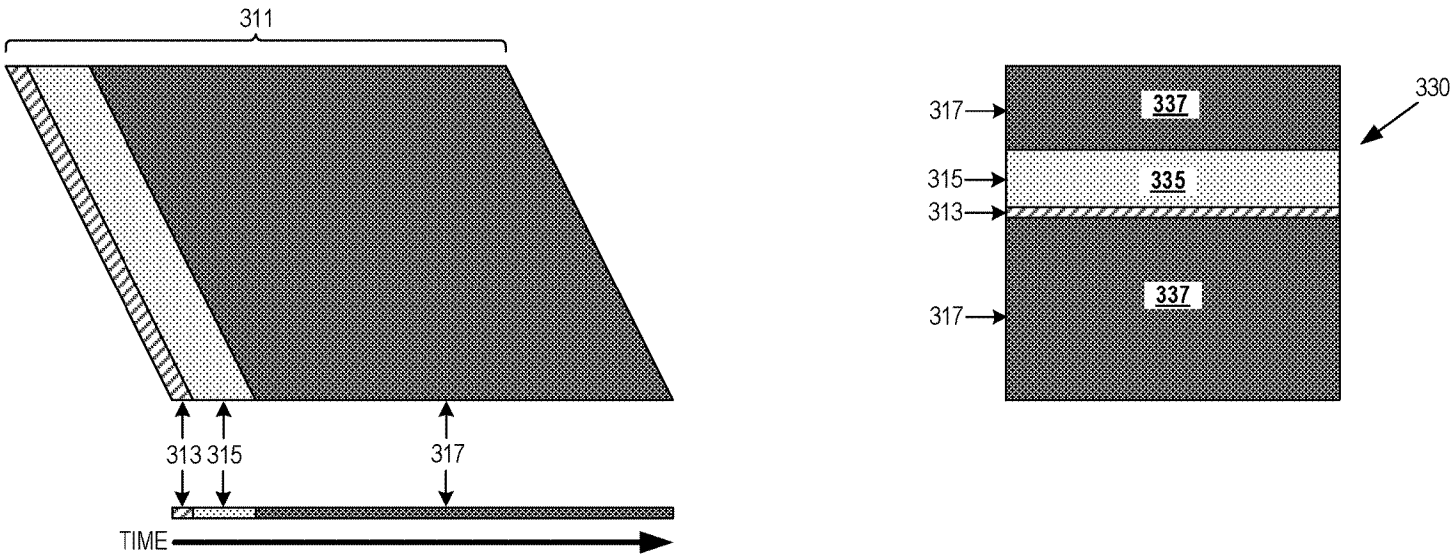
FIGS. 3A and 3B illustrate example rolling shutter techniques for refreshing images rendered on an OLED display, in accordance with an embodiment of the disclosure.
Figure 3B:
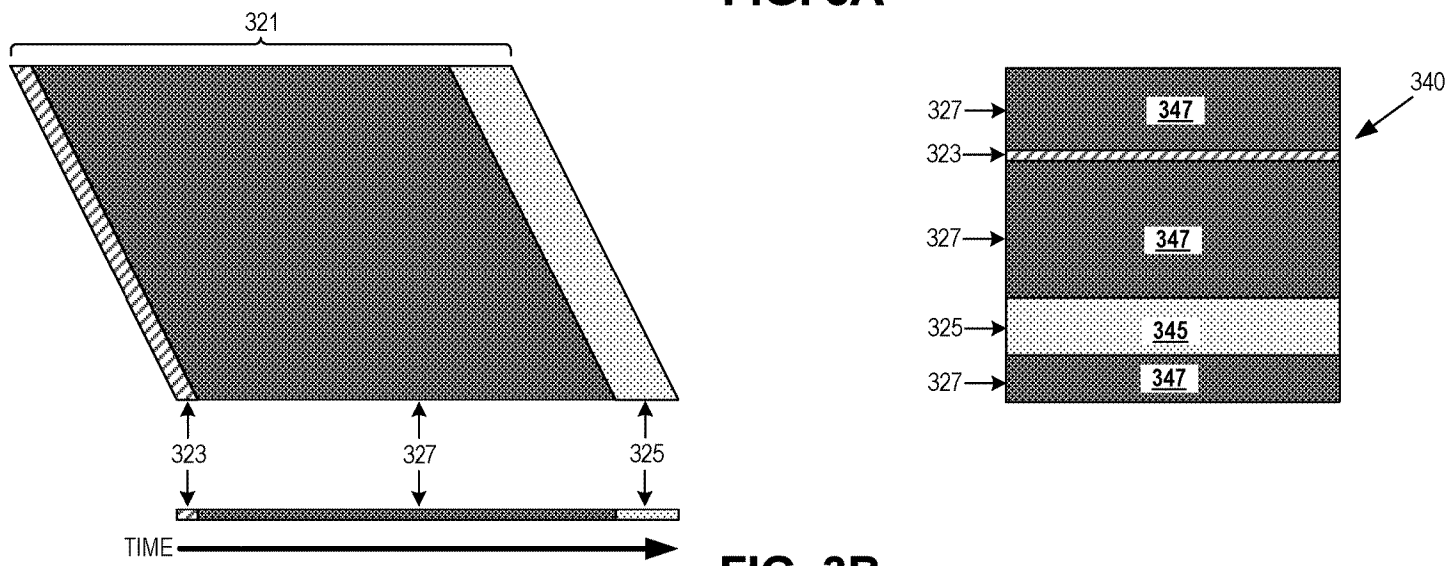

As briefly stated above, display pixel crosstalk may be particularly pronounced in low persistence rolling shutter display architectures. FIGS. 3A and 3B illustrate example rolling shutter techniques for refreshing images rendered on an OLED display, in accordance with an embodiment of the disclosure.

In FIG. 3A, low persistence rolling shutter technique 311 starts with a programming time period 313 followed by an illumination period 315 and then an off time 317. The rolling shutter progressively updates the display line-by-line with the image frame from video content. During the programming time period 313, driver IC 115 drives the grey level onto each display pixel in the line. Snapshot 330 shows a moment in time of an image frame being rendered to an OLED display where an illuminated pixel portion 335 of an OLED display is illuminated corresponding with the illumination period 315. Also in snapshot 330, a dark pixel portion 337 of the OLED display corresponding with off time 317 is not illuminated. In one embodiment, ten percent of the lines of an OLED display are illuminated at one time which corresponds to an illumination period 315 that is ten percent of the off time 317. Hence, in an embodiment with 1600 lines in the display, only 160 of the lines would be illuminated at any one time, which is why the image rendering technique is considered "low persistence." In one embodiment, five percent of the lines in the display are illuminated at any given time and the illumination period 315 is five percent of the off time 317. Of course other percentages of lines that are illuminated at one time are possible.

In FIG. 3B, low persistence rolling shutter technique 321 is similar to low persistence rolling shutter technique 311 except that the programming time period 323 is followed by off time 327 and the illumination period 325 follows the off time 327. Snapshot 340 shows a moment in time of an image frame being rendered to an OLED display where an illuminated pixel portion 345 of an OLED display is illuminated corresponding with the illumination period 325. Also in snapshot 340, a dark pixel portion 347 of the OLED display corresponding with off time 327 is not illuminated.

Figure 4:
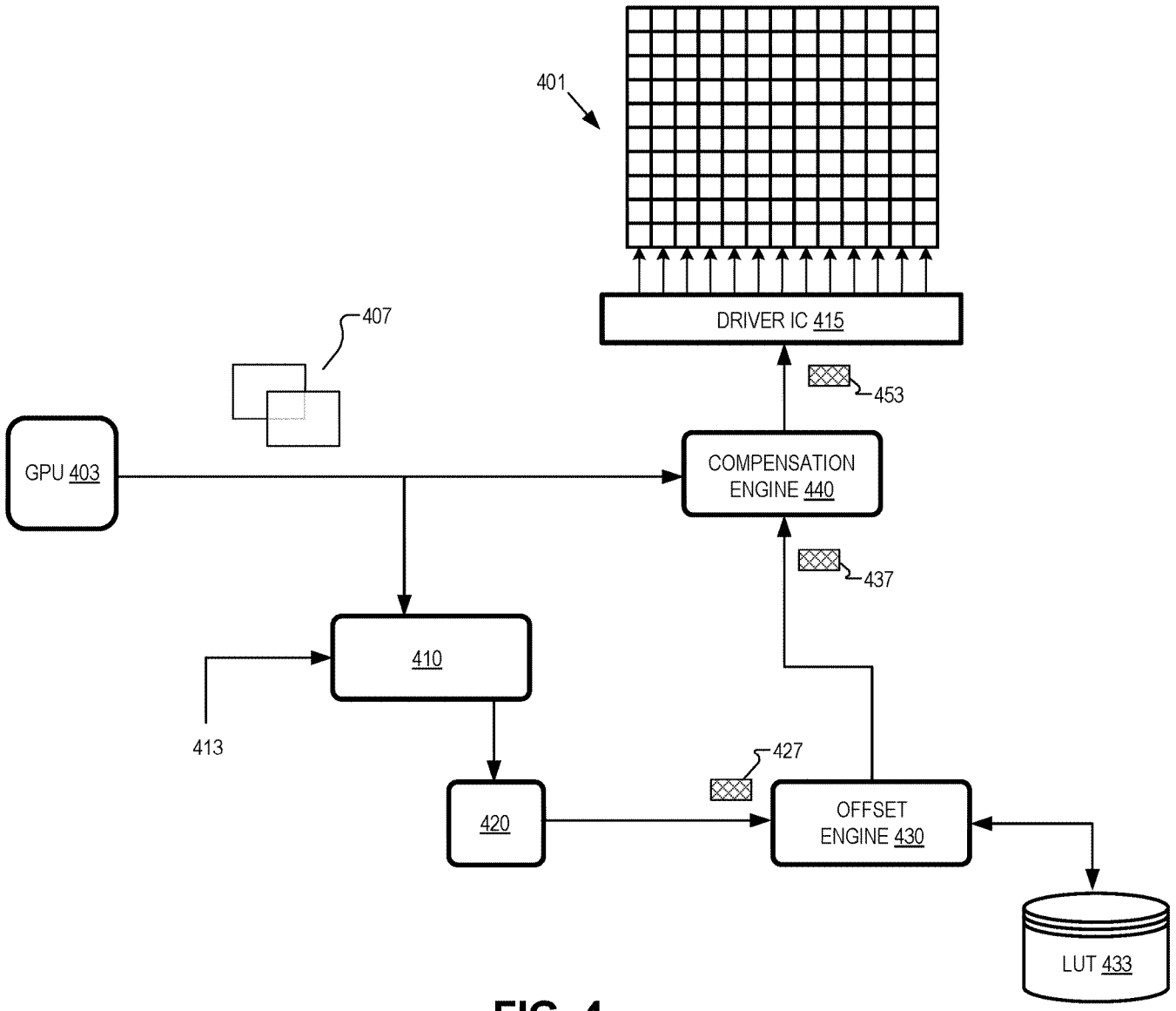
FIG. 4 illustrates an example block diagram schematic that includes a compensation engine for providing compensated pixel grey levels to an OLED display, in accordance with an embodiment of the disclosure.

FIG. 4 illustrates an example block diagram schematic that includes a compensation engine 440 for providing compensated pixel grey levels to OLED display 401, in accordance with an embodiment of the disclosure. The schematic of FIG. 4 may be used to mitigate display image crosstalk that may be particularly pronounced in low persistence rolling shutter architectures.

FIG. 4 includes a Graphics Processing Unit (GPU) 403, a buffer memory 410, an aggregation engine 420, an offset engine 430, a look-up-table 433, and a compensation engine 440. GPU 403 outputs video content 407. Video content 407 may have a plurality of image frames. Buffer memory 410 is configured to receive a portion of an image frame of video content 407. The portion of the image frame received by the buffer memory may correspond to illuminated pixel portion 335 or illuminated pixel portion 345 of FIGS. 3A and 3B. In one embodiment, the portion of the image frame is one line of display pixels of the OLED display 401. In one embodiment, the portion of the image frame is multiple lines of display pixels of the OLED display 401.

In the illustrated embodiment, buffer memory 410 is configured to receive a low persistence duty cycle signal 413 for updating the buffer memory 410. The low persistence duty cycle signal 413 may be driven according to the rolling shutter that updates the OLED display 401 and prompt the buffer memory 410 to update in sync with the rolling shutter.

Aggregation engine 420 is configured to generate a grey level total 427 of the portion of the image frame stored in buffer memory 410. In one embodiment, aggregation engine 420 sums the grey levels of the portion of the image frame stored in buffer memory 410 to generate the grey level total 427.

Offset engine 430 is configured to generate a grey level offset value 437 in response to receiving the grey level total 427 from the aggregation engine 420, in the illustrated embodiment. The grey level offset value 437 corresponds to the pixel portion (e.g. illuminated portion 435 or 445) that will display the portion of the image frame stored in buffer memory 410.

In the illustrated embodiment, offset engine 430 queries look-up-table 433 for the grey level offset value 437 that corresponds to the grey level total 427 for the portion of the image frame stored in buffer memory 410. Look-up-table 433 may be stored in a computer-readable medium such as a memory or memories. Look-up-table 433 may include a relational database that includes a grey level offset value for each possible grey level total for the portion of the image frame. The grey level offset values in the look-up-table 433 may be derived from calibrated light measurements of the pixel portion of the specific OLED display 401. The calibrated light measurements may be measured at the facility that manufactures the OLED display 401. Calibration patterns such as checkerboard patterns or different grey scale value images may be driven onto the OLED display 401 to determine the light output of a particular pixel portion when different grey levels are driven onto the pixel portion. Therefore, the calibrated light measurements can be used to predict the impact of driving similar grey levels on a particular pixel portion. Hence, determining a grey level total (e.g. grey level total 427) driven onto a particular pixel portion and matching that grey level total to calibrated light measurements of that pixel portion with similar grey level totals driven onto the pixel portion can provide a grey level offset value to be applied to the grey levels of the pixel portion to compensate for a voltage drop across resistive values 213 and 215. And, compensating for the voltage drop (according to image content) across resistive values 213 and 215 mitigates the crosstalk between proximate display pixels.

In one embodiment, a query of look-up-table 433 includes a grey level total 427 and a pixel portion value so that the grey level offset value 437 from the look-up-table 433 is specific to the pixel portion that will drive the portion of the image frame. Look-up-table 433 may include a plurality of table grey level totals corresponding to a plurality of table grey level offset values being specifically calibrated for the plurality of pixel portions of the OLED display 401.

Compensation engine 440 is configured to receive the portion of the image frame of video content 407 from GPU 403 and compensation engine 440 is also configured to receive the grey level offset value 437 from offset engine 430. Compensation engine 440 is configured to generate compensated pixel grey levels 453 for individual pixels in the pixel portion of the OLED display 401 based at least in part on the grey level offset value 437. In the illustrated embodiment, compensation engine 440 is configured to provide the compensated pixel grey levels 453 to the driver IC 415 of the OLED display 401.

Figure 5:
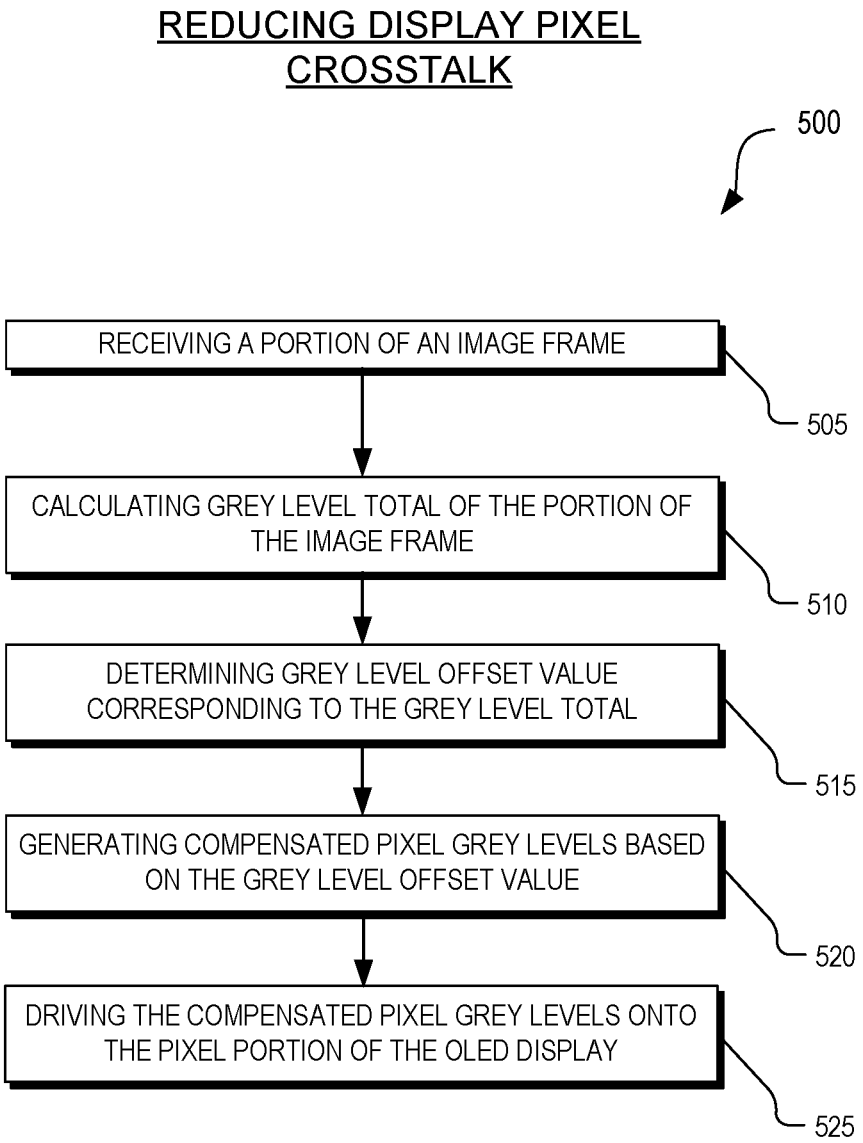
FIG. 5 illustrates a flow chart illustrating an example process of reducing display pixel crosstalk, in accordance with an embodiment of the disclosure.

FIG. 5 illustrates a flow chart illustrating an example process 500 of reducing display pixel crosstalk, in accordance with an embodiment of the disclosure. The order in which some or all of the process blocks appear in process 500 should not be deemed limiting. Rather, one of ordinary skill in the art having the benefit of the present disclosure will understand that some of the process blocks may be executed in a variety of orders not illustrated, or even in parallel. Process 500 may be executed by the structures illustrated in FIG. 4.

In process block 505, a portion of an image frame is received. The image frame may be included in video content such as video content 407.

In process block 510, a grey level total of the portion of the image frame is calculated. In one embodiment, the grey level total is the sum of grey levels of the portion of the image frame that is received in process block 505.

In process block 515, a grey level offset value corresponding to the grey level total is determined. Determining the grey level offset value may include querying a look-up-table that includes the grey level offset value that corresponds to the grey level total.

In process block 520, compensated pixel grey levels are generated. Generating the compensated pixel grey levels includes adjusting individual pixel grey levels of the portion of the image frame based at least in part on the grey level offset value.

In process block 525, the compensated pixel grey levels are driven onto the pixel portion of the OLED display (e.g. OLED display 401). The compensated pixel grey levels may be driven onto the pixel portion of the OLED display for a low persistence time period (e.g. illumination period 315 or 325) that is less than a frame time (e.g. the sum of programming time period 313, illumination period 315 and off time 317) allocated to the image frame. The compensated pixel grey levels are driven onto the pixel portion of the OLED display for the low persistence time period as part of a rolling shutter.

In one embodiment, process 500 further includes receiving a second portion of the image frame of the video content subsequent to receiving the portion of the image frame received in process block 505. The second portion of the image frame may be the same size as the portion of the image frame received in process block 505. A second grey level total of the second portion of the image frame is calculated and a second grey level offset value is determined. The second grey level offset value corresponds to the second grey level total where the second grey level offset value corresponds to a second pixel portion of the OLED display that will display the second portion of the image frame. Second compensated pixel grey levels are generated where generating the second compensated pixel grey levels includes adjusting the second individual pixel grey levels of the second portion of the image frame based at least in part on the second grey level offset value. The second compensated pixel grey levels are then driven on the second pixel portion of the OLED display subsequent to the compensated pixel grey levels being driven on the pixel portion of the OLED display.

Figure 6:
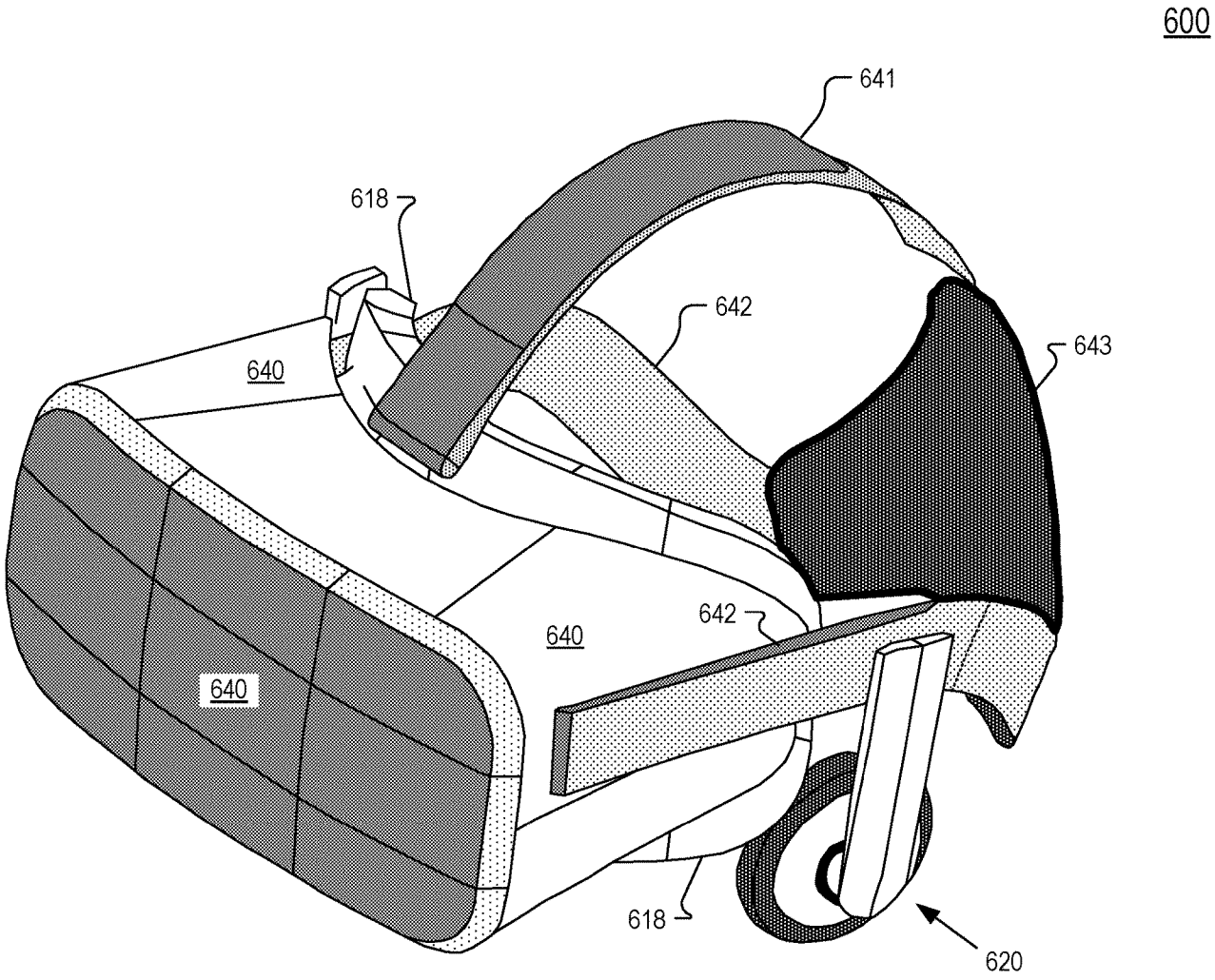
FIG. 6 illustrates an example head mounted display (HMD) that may include one or more OLED displays and a compensation engine for reducing display pixel crosstalk, in accordance with an embodiment of the disclosure.

FIG. 6 illustrates an example head mounted display (HMD) 600 including a top structure 641, a rear securing structure 643, and a side structure 642 attached with a viewing structure 640. The illustrated HMD 600 is configured to be worn on a head of a user of the HMD. In one embodiment, top structure 641 includes a fabric strap that may include elastic. Side structure 642 and rear securing structure 643 may include a fabric as well as rigid structures (e.g. plastics) for securing the HMD to the head of the user. HMD 600 may optionally include earpiece(s) 620 configured to deliver audio to the ear(s) of a wearer of HMD 600.

In the illustrated embodiment, viewing structure 640 includes an interface membrane 618 for contacting a face of a wearer of HMD 600. Interface membrane 618 may function to block out some or all ambient light from reaching the eyes of the wearer of HMD 600.

Example HMD 600 also includes a chassis for supporting hardware of the viewing structure 640 of HMD 600. Hardware of viewing structure 640 may include any of processing logic, wired and/or wireless data interface for sending and receiving data, graphic processors, and one or more memories for storing data and computer-executable instructions. In one embodiment, viewing structure 640 may be configured to receive wired power. In one embodiment, viewing structure 640 is configured to be powered by one or more batteries. In one embodiment, viewing structure 640 may be configured to receive wired data including video data. In one embodiment, viewing structure 640 is configured to receive wireless data including video data.

Viewing structure 640 may include an OLED display for directing image light to a wearer of HMD 600. Viewing structure 640 may also include the structures of FIG. 4 including GPU 403 and engines 420, 430, and 440. Engines 420, 430, and 440 may include processing logic that includes one or more processors, microprocessors, multicore processors, Application-specific integrated circuits (ASIC), and/or Field Programmable Gate Arrays (FPGAs) to execute operations disclosed herein. In some embodiments, memories (not illustrated in FIG. 4) are integrated into the processing logic to store instructions to execute operations and/or store data. Processing logic may also include analog or digital circuitry to perform the operations in accordance with embodiments of the disclosure. Engines 420, 430, and 440 may be implemented together in a system on a chip (SOC) in some embodiments.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Although the disclosure is most significantly described in the context of an HMD, those skilled in the art recognize that embodiments of the disclosure could be utilized in any apparatus or computing device that includes an OLED display. A computing device may include a laptop computer, a tablet, a phablet, a smartphone, a feature phone, a smartwatch, or otherwise.

A "memory" or "memories" described in this disclosure may include one or more volatile or non-volatile memory architectures. The "memory" or "memories" may be removable and non-removable media implemented in any method or technology for storage of information such as computer-readable instructions, data structures, program modules, or other data. Example memory technologies may include RAM, ROM, EEPROM, flash memory, CD-ROM, digital versatile disks (DVD), high-definition multimedia/data storage disks, or other optical storage, magnetic cassettes, magnetic tape, magnetic disk storage or other magnetic storage devices, or any other non-transmission medium that can be used to store information for access by a computing device.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible non-transitory machine-readable storage medium includes any mechanism that provides (i.e., stores) information in a form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined by the following claims, which are to be construed in accordance with established doctrines of claim interpretation.

What is claimed is:

1. A computer-implemented method of reducing display pixel crosstalk, the method comprising: receiving a portion of an image frame of video content; calculating a grey level total of the portion of the image frame prior to displaying the image frame, wherein the portion of the image frame is a line of the image frame that is a pixel row or pixel column of the image frame, and wherein the grey level total is a summing of digital grey levels of the line of the image frame of a digital image; determining a grey level offset value corresponding to the grey level total, wherein the grey level offset value corresponds to a pixel portion of an Organic Light Emitting Diode (OLED) display that will display the portion of the image frame, and wherein the pixel portion is a pixel line of the OLED display having pixels that share a voltage supply rail; generating compensated pixel grey levels for the portion of the image frame of video content, wherein generating the compensated pixel grey levels includes adjusting individual pixel grey levels of the line of the image frame based at least in part on the grey level offset value; and driving the compensated pixel grey levels onto the pixel line of the OLED display, wherein generating compensated pixel grey levels for the portion of the image frame of the video content is at least partially based on the digital grey levels of the line of the image frame of the digital image, prior to driving the compensated pixel grey levels onto the pixel line of the OLED display to render the line of the image frame of the digital image on the OLED display.

2. The computer-implemented method of claim 1, wherein the compensated pixel grey levels are driven onto the pixel portion of the OLED display for a low persistence time period that is less than a frame time allocated to the image frame.

3. The computer-implemented method of claim 2, wherein the compensated pixel grey levels are driven onto the pixel portion of the OLED display for the low persistence time period as part of a rolling shutter.

4. The computer-implemented method of claim 1, wherein determining the grey level offset value includes querying a look-up-table that includes the grey level offset value that corresponds to the grey level total, the grey level offset value calibrated from light measurements of the pixel portion of the OLED display being illuminated.

5. The computer-implemented method of claim 1 further comprising:

receiving a second portion of the image frame of the video content subsequent to receiving the portion of the image frame, wherein the second portion of the image frame is a same size as the portion of the image frame;

calculating a second grey level total of the second portion of the image frame;

determining a second grey level offset value corresponding to the second grey level total, wherein the second grey level offset value corresponds to a second pixel portion of the OLED display that will display the second portion of the image frame;

generating second compensated pixel grey levels, wherein generating the second compensated pixel grey levels includes adjusting second individual pixel grey levels of the second portion of the image frame based at least in part on the second grey level offset value; and driving the second compensated pixel grey levels onto the second pixel portion of the OLED display subsequent to driving the compensated pixel grey levels onto the pixel portion of the OLED display.

6. The computer-implemented method of claim 1, wherein the portion of the image frame includes the individual pixel grey levels of the portion of the image frame, and wherein calculating the grey level total includes summing the individual pixel grey levels for each pixel in the portion of the image frame.

7. The computer-implemented method of claim 1, wherein generating the compensated pixel grey levels includes adding the grey level offset value to the individual pixel grey levels.

8. The computer-implemented method of claim 1, wherein the portion of the image frame is received from a graphics processing unit (GPU) and stored in a buffer memory.

9. A Head Mounted Display (HMD) comprising: an organic light emitting diode (OLED) display; a graphics processing unit (GPU); a buffer memory configured to receive a portion of an image frame of video content from the GPU; an aggregation engine configured to generate a grey level total of the portion of the image frame stored in the buffer memory prior to displaying the image frame, wherein the portion of the image frame is a line of the image frame that is a pixel row or pixel column of the image frame, and wherein the grey level total is a summing of digital grey levels of the line of the image frame of a digital image; an offset engine configured to generate a grey level offset value in response to receiving the grey level total, wherein the grey level offset value corresponds to a pixel portion of the OLED display that will display the portion of the image frame, and wherein the pixel portion is a pixel line of the OLED display having pixels that share a voltage supply rail; and a compensation engine configured to receive the line of the image frame of video content from the GPU and configured to receive the grey level offset value from the offset engine, wherein the compensation engine is configured to generate compensated pixel grey levels for individual pixels in the pixel line of the OLED display based at least in part on the grey level offset value and at least in part based on the digital grey levels of the line of the image frame of the digital image, prior to the line of the image frame of the digital image being rendered on the OLED display, wherein the compensation engine is further configured to provide the compensated pixel grey levels to the OLED display to enable rendering of the line of the image frame of the digital image.

10. The HMD of claim 9, wherein the buffer memory is configured to receive a low persistence duty cycle signal for updating the buffer memory, and wherein the low persistence duty cycle signal is driven according to a rolling shutter that updates the OLED display.

11. The HMD of claim 9, wherein the offset engine is configured to query a look-up-table to generate the grey level offset value, wherein each table grey level total in the look-up-table has a corresponding table grey level offset value in the look-up-table calibrated from light measurements of the pixel portion of the OLED display.

12. The HMD of claim 9, wherein the OLED display includes a driver integrated-circuit configured to receive the compensated pixel grey levels and drive the compensated pixel grey levels on the pixel portion of the OLED display.

13. The HMD of claim 12, wherein the driver integrated-circuit is configured to drive the compensated pixel grey levels on the pixel portion of the OLED display for a low persistence time that is less than a frame time allocated to the image frame.

14. A device comprising: an organic light emitting diode (OLED) display; a computer-readable medium including a look-up-table including a plurality of table grey level offset values corresponding to table grey level totals for a plurality of pixel portions of the OLED display, the plurality of table grey level offset values being specifically calibrated for the plurality of pixel portions of the OLED display; a buffer memory configured to receive digital grey levels of a portion of an image frame of video content prior to displaying the image frame, wherein the portion of the image frame is a line of the image frame that is a pixel row or pixel column of the image frame of a digital image; an aggregation engine configured to generate a grey level total of the portion of the image frame by summing the digital grey levels of the line of the image frame in the buffer memory; an offset engine configured to query the look-up-table for a grey level offset value of the plurality of table grey level offset values that corresponds to the grey level total, wherein the grey level offset value corresponds to a pixel portion of the plurality of pixel portions of the OLED display that will display the portion of the image frame, and wherein the pixel portion is a pixel line of the OLED display having pixels that share a voltage supply rail; and a compensation engine configured to receive the line of the image frame and configured to generate compensated pixel grey levels for individual pixels in the pixel line of the OLED display based at least in part on the grey level offset value and at least in part based on the digital grey levels of the line of the image frame in the digital image, prior to the line of the image frame of the digital image being rendered on the OLED display, to enable a compensated rendering of the line of the image frame of the digital image on the OLED display.

15. The device of claim 14, wherein the buffer memory is configured to receive a low persistence duty cycle signal for updating the buffer memory, and wherein the low persistence duty cycle signal is driven according to a rolling shutter that updates the OLED display.

16. The device of claim 14, wherein the plurality of table grey level offset values is calibrated from light measurements of the plurality of pixel portions of the OLED display.

* * * * *